US012492477B2

(12) United States Patent
Takeda et al.

(10) Patent No.: US 12,492,477 B2
(45) Date of Patent: Dec. 9, 2025

(54) NON-ORIENTED ELECTRICAL STEEL SHEET AND SURFACE TREATMENT AGENT FOR NON-ORIENTED ELECTRICAL STEEL SHEET

(71) Applicant: NIPPON STEEL CORPORATION, Tokyo (JP)

(72) Inventors: Kazutoshi Takeda, Tokyo (JP); Shuichi Yamazaki, Tokyo (JP); Takuya Matsumoto, Tokyo (JP); Hiroyasu Fujii, Tokyo (JP); Masaru Takahashi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 876 days.

(21) Appl. No.: 17/761,958

(22) PCT Filed: Sep. 18, 2020

(86) PCT No.: PCT/JP2020/035519
§ 371 (c)(1),
(2) Date: Mar. 18, 2022

(87) PCT Pub. No.: WO2021/054450
PCT Pub. Date: Mar. 25, 2021

(65) Prior Publication Data

US 2022/0341043 A1 Oct. 27, 2022

(30) Foreign Application Priority Data

Sep. 20, 2019 (JP) ..... 2019-171251

(51) Int. Cl.
*C23C 22/20* (2006.01)
*C21D 9/46* (2006.01)
*C23C 22/82* (2006.01)

(52) U.S. Cl.
CPC ..... *C23C 22/20* (2013.01); *C21D 9/46* (2013.01); *C23C 22/82* (2013.01)

(58) Field of Classification Search
None
See application file for complete search history.

(56) References Cited

U.S. PATENT DOCUMENTS

2017/0342568 A1 11/2017 Yamazaki et al.

FOREIGN PATENT DOCUMENTS

EP 3 263 741 A1 1/2018
JP 11-80971 A 3/1999
(Continued)

*Primary Examiner* — Anthony M Liang
(74) *Attorney, Agent, or Firm* — Birch, Stewart, Kolasch & Birch, LLP

(57) ABSTRACT

There is provided a non-oriented electrical steel sheet that includes a base metal steel sheet and an insulating coating film that is formed on a surface of the base metal steel sheet, wherein the insulating coating film mainly contains metal phosphate, organic resin, and water-soluble organic compound, the water-soluble organic compound has an SP value that is within a range of 10.0 to 20.0 $(cal/cm^3)^{1/2}$, the metal phosphate contains aluminum and zinc as metallic elements, and when measurement by an X-ray photoelectron spectroscopy is performed from a surface of the insulating coating film in a thickness direction of the non-oriented electrical steel sheet, a depth at which a strength of a 2p peak of zinc reaches a maximum is present closer to the surface side than a depth at which a strength of a 2p peak of aluminum reaches a maximum, and a maximum value of the strength of the 2p peak of zinc is 1 to 20 times a strength of the 2p peak of aluminum at the depth at which the strength of the 2p peak of zinc reaches a maximum.

4 Claims, 2 Drawing Sheets

(56) References Cited

FOREIGN PATENT DOCUMENTS

| | | | |
|---|---|---|---|
| JP | 2009-120951 | A | 6/2009 |
| JP | 2017-141480 | A | 8/2017 |

NON-ORIENTED ELECTRICAL STEEL SHEET AND SURFACE TREATMENT AGENT FOR NON-ORIENTED ELECTRICAL STEEL SHEET

TECHNICAL FIELD

The present invention relates to a non-oriented electrical steel sheet and a surface treatment agent for a non-oriented electrical steel sheet.

BACKGROUND ART

Surfaces of non-oriented electrical steel sheets are typically provided with insulating coating films. In addition to insulation property, various coating properties are required for insulating coating films such as corrosion resistance, adhesiveness, heat resistance for resisting annealing, and stability as coatings. In conventional practices, insulating coating films are blended with a chromate, and thereby the coating properties are provided at an extremely high level. However, amid growing awareness of environmental issues, insulating coating films without chromates have recently been developed.

For example, Patent Document 1 discloses a non-oriented electrical steel sheet including an insulating coating film that mainly contains an organic resin and a metal phosphate of one type selected from specific metal elements.

LIST OF PRIOR ART DOCUMENTS

Patent Document

Patent Document 1: JP11-80971A

SUMMARY OF INVENTION

Technical Problem

However, although the insulating coating film improves punchability (i.e., workability) and exerts excellent insulation property in the case where an insulating coating film without a chromate as disclosed in Patent Document 1 is used, there is still room for improvement in providing an insulating coating film that further combines adhesiveness, corrosion resistance, and heat resistance.

An objective of the present invention, which has been made in view of such a problem, is to provide a non-oriented electrical steel sheet including an insulating coating film that is excellent in insulation property, workability, adhesiveness, corrosion resistance, and heat resistance without containing a chromate and provide a surface treatment agent for a non-oriented electrical steel sheet for forming the insulating coating film.

Solution to Problem

The present invention has been made to solve the above problem and has a gist of the following non-oriented electrical steel sheet and surface treatment agent for a non-oriented electrical steel sheet.

(1) A non-oriented electrical steel sheet including a base metal steel sheet and an insulating coating film that is formed on the base metal steel sheet, wherein the insulating coating film contains metal phosphate, organic resin, and water-soluble organic compound at 50 mass % or more in total with respect to a total mass of the insulating coating film, the water-soluble organic compound has an SP value that is within a range of 10.0 to 20.0 $(cal/cm^3)^{1/2}$, the metal phosphate contains aluminum and zinc as metallic elements, and when measurement by an X-ray photoelectron spectroscopy is performed from a surface of the insulating coating film in a thickness direction of the non-oriented electrical steel sheet, a depth at which a strength of a 2p peak of zinc reaches a maximum is present closer to the surface side than a depth at which a strength of a 2p peak of aluminum reaches a maximum, and a maximum value of the strength of the 2p peak of zinc is 1 to 20 times a strength of the 2p peak of aluminum at the depth at which the strength of the 2p peak of zinc reaches a maximum.

(2) The non-oriented electrical steel sheet according to (1) above, wherein the insulating coating film contains, as the organic resin, 3 to 50 parts by weight of an acrylic resin per 100 parts by weight of the metal phosphate.

(3) The non-oriented electrical steel sheet according to (1) or (2) above, wherein the metal phosphate further contains, as a metallic element, one or more types selected from the group consisting of Co, Mg, Mn, and Ni.

(4) A surface treatment agent for a non-oriented electrical steel sheet, the surface treatment agent for forming an insulating coating film on a surface of the non-oriented electrical steel sheet, the surface treatment agent including:

3 to 50 parts by weight of organic resin and 5 to 50 parts by weight of water-soluble organic compound per 100 parts by weight of metal phosphate containing aluminum and zinc, wherein the water-soluble organic compound has an SP value that is within a range of 10.0 to 20.0 $(cal/cm^3)^{1/2}$, and a molar ratio between aluminum element and zinc element in the metal phosphate (Al:Zn) is within a range of 10:90 to 75:25.

(5) The surface treatment agent for a non-oriented electrical steel sheet according to (4) above, wherein the organic resin is an acrylic resin.

(6) The surface treatment agent for a non-oriented electrical steel sheet according to (4) or (5) above, further including a metal phosphate including one or more elements selected from the group consisting of Co, Mg, Mn, and Ni.

Advantageous Effects of Invention

According to the present invention, it is possible to obtain a non-oriented electrical steel sheet including an insulating coating film that is excellent in insulation property, workability, adhesiveness, corrosion resistance, and heat resistance without containing a chromate.

DESCRIPTION OF EMBODIMENTS

Figure 1:
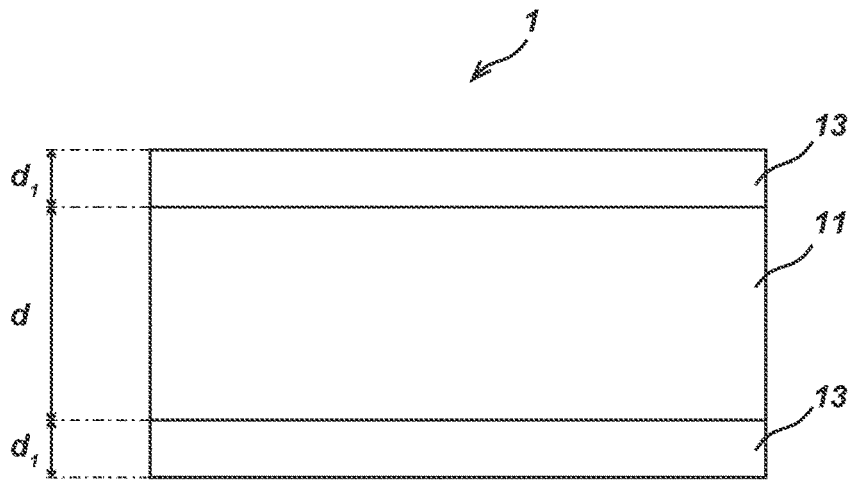
FIG. 1 is a schematic diagram for describing a structure of a non-oriented electrical steel sheet according to an embodiment of the present invention.

The present inventors conducted intensive studies about a method for providing an insulating coating film that combines insulation property, workability, adhesiveness, corrosion resistance, and heat resistance and consequently came to obtain the following findings.

(a) To exert all of many types of properties including insulation property, workability, adhesiveness, corrosion resistance, and heat resistance, it is necessary to utilize a metal phosphate that contains a plurality of metallic elements.

(b) As a result of the studies by the present inventors, the present inventors found that, by concentrating a metal phosphate of zinc, which is excellent in corrosion resistance, on a surface side of an insulating coating film and by concentrating a metal phosphate of aluminum, which is excellent in adhesiveness and heat resistance, on a base metal steel sheet side, it is possible to combine, in addition to insulation property and workability, adhesiveness, corrosion resistance, and heat resistance.

(c) However, only by adjusting contents of aluminum and zinc added to a surface treatment agent in the form of their metal phosphates, it was impossible to provide a coating structure in which the metal phosphate of zinc is concentrated on the surface side of an insulating coating film, and the metal phosphate of aluminum is concentrated on the base metal steel sheet side.

(d) The present inventors formed insulating coating films under various conditions and analyzed structures of the coating films, as a result of which the coating structure described above was able to be provided by controlling a composition of a water-soluble organic compound that is added to a surface treatment agent together with the metal phosphates and controlling a condition for heating performed after the surface treatment agent is applied.

(e) Although the mechanism of how the metal phosphate of zinc is concentrated on the surface side of an insulating coating film and how the metal phosphate of aluminum is concentrated on the base metal steel sheet side is unclear, it is conjectured that stabilities of metal ions in the metal phosphates have influence.

(f) In their aqueous solutions, many metal phosphates are unstable and tend to precipitate early. Thus, metal phosphates are often concentrated on a steel sheet side. However, by optimizing a composition and additive amounts of water-soluble organic compounds in a surface treatment agent, it is possible to cause a difference in stability between metallic elements and particularly to improve the stability of the metal phosphate of zinc. As a result, the metal phosphate of zinc, which has a high stability, precipitates later than the metal phosphate of aluminum, which has a relatively low stability, and is concentrated on the surface side of an insulating coating film.

(g) Additionally, to make a difference in position of concentration between zinc and aluminum, it is necessary to keep a time for the elements in a surface treatment agent to diffuse sufficiently, from the application of the surface treatment agent to a surface of a base metal steel sheet until the surface treatment agent is solidified. From this viewpoint, the base metal steel sheet is left as it is for a predetermined time period from the application of the surface treatment agent, and a heating rate and a heating temperature are both controlled to be low.

(h) By the above optimizations of the conditions, the metal phosphate of zinc was concentrated on the surface side of the insulating coating film, making it possible to form a coating film in which the metal phosphate of aluminum is concentrated on the base metal steel sheet side.

The present invention has been made based on the findings described above. Requirements of the present invention will be described below.

1. General Configuration of Non-Oriented Electrical Steel Sheet

FIG. 1 is a schematic diagram for describing a structure of a non-oriented electrical steel sheet according to the present embodiment. A non-oriented electrical steel sheet 1 includes a base metal steel sheet 11 and insulating coating films 13 that are formed on surfaces of the base metal steel sheet 11. Although the insulating coating films 13 are provided on the surfaces on both sides of the base metal steel sheet 11 in a thickness direction of the base metal steel sheet 11 in FIG. 1, an insulating coating film 13 may be provided on only a surface of one side of the base metal steel sheet 11.

2. Base Metal Steel Sheet

There is no particular limitation on a steel type of the base metal steel sheet 11 used for the non-oriented electrical steel sheet 1. For example, it is preferable to use a non-oriented electrical steel sheet having a chemical composition that contains, in mass %, Si: 0.1% or more and Al: 0.05% or more, with the balance being Fe and impurities.

Si (silicon) is an element that increases electric resistance and improves magnetic properties when its content is 0.1 mass % or more. As the content of Si increases, the magnetic properties are improved, but at the same time, brittleness tends to increase with an increase in the electric resistance. The increase in brittleness becomes prominent when the content of Si becomes more than 4.0 mass %, and the content of Si is thus preferably 4.0 mass % or less.

As with Si, Al (aluminum) is an element that increases electric resistance and improves magnetic properties when its content is 0.05 mass % or more. As the content of Al increases, the magnetic properties are improved, but at the same time, rolling properties tend to decrease with an increase in the electric resistance. The decrease in rolling properties becomes prominent when the content of Al becomes more than 3.0 mass %, and the content of Al is thus preferably 3.0 mass % or less.

As long as a non-oriented electrical steel sheet has the content of Si and the content of Al described above, there is no particular limitation on the non-oriented electrical steel sheet, and various types of known non-oriented electrical steel sheets can be used as the base metal steel sheet 11.

In addition to Si and Al described above, Mn (manganese) can be contained in the base metal steel sheet 11 within the range of 0.01 to 3.0 mass % in lieu of a part of Fe in the balance. In addition, in the base metal steel sheet according to the present embodiment, contents of other elements such as S (sulfur), N, (nitrogen), and C (carbon) are preferably less than 100 ppm in total, more preferably less than 30 ppm.

In the present embodiment, an ingot (e.g., slab) having the chemical composition is subjected to hot rolling and coiled into a coil as a hot-rolled sheet, annealed within the temperature range of 800 to 1050° C. as being in a state of the hot-rolled sheet when necessary, then subjected to cold rolling to have a thickness of 0.15 to 0.50 mm, and further annealed to be produced into a base metal steel sheet, which is preferably used as the base metal steel sheet 11. A sheet thickness of the base metal steel sheet 11 is more preferably 0.25 mm or less. In addition, in the annealing after the cold rolling, its annealing temperature is preferably within the range of 750 to 1000° C.

Furthermore, the base metal steel sheet 11 preferably has a relatively small surface roughness because a small surface roughness gives favorable magnetic properties. Specifically, arithmetic average roughnesses (Ra) in a rolling direction and a direction perpendicular to the rolling direction are both preferably 1.0 μm or less, more preferably 0.1 to 0.5 μm. This is because Ra being more than 1.0 μm tends to cause deterioration in the magnetic properties.

3. Insulating Coating Film

The insulating coating film 13 is formed at least on the surface on one side of the base metal steel sheet 11. The insulating coating film is an insulating coating film that mainly contains a metal phosphate, an organic resin, and a water-soluble organic compound to be described below in detail and does not contain chromium. Specifically, the insulating coating film contains the metal phosphate, the organic resin, and the water-soluble organic compound at 50 mass % or more in total with respect to the total mass of the insulating coating film. Each component will be described below in detail.

3-1. Metal Phosphate

The metal phosphate contained in the insulating coating film becomes solid content when a solution (e.g., aqueous solution, etc.) mainly containing a phosphoric acid and metal ions is dried and functions as a binder in the insulating coating film. There is no particular limitation on the type of the phosphoric acid, and various types of known phosphoric acids can be used; for example, orthophosphoric acid, metaphosphatic acid, polyphosphoric acid, or the like is preferably used. The solution of the metal phosphate can be prepared by mixing at least any one of oxides, carbonates, and hydroxides of metal ions into one of the various types of the phosphoric acids.

The metal phosphate contains Al (aluminum) and Zn (zinc) as metallic elements. In other words, the insulating coating film contains a metal phosphate of Al (i.e., aluminum phosphate) and a metal phosphate of Zn (i.e., zinc phosphate).

The insulating coating film according to the present embodiment may further contain, in addition to the metal phosphates of Al and Zn, another metal phosphate of a divalent metallic element M. Such a divalent metallic element M can be one or more types selected from the group consisting of, for example, Co, Mg, Mn, and Ni. When a metal phosphate having the metallic element M as described above is contained in addition to the aluminum phosphate and the zinc phosphate, it is possible to densify more the insulating coating film to further improve the properties of the insulating coating film.

In the present invention, as described above, an insulating coating film that combines insulation property, workability, adhesiveness, corrosion resistance, and heat resistance is provided by concentrating the zinc phosphate on the surface side of the insulating coating film and concentrating the aluminum phosphate on the base metal steel sheet side.

More specifically, in the non-oriented electrical steel sheet according to the present invention, when measurement by the X-ray photoelectron spectroscopy (XPS) is performed from a surface of the insulating coating film in the thickness direction, a depth at which the strength of the 2p peak of Zn reaches its maximum is present closer to the surface than a depth at which the strength of the 2p peak of Al reaches its maximum (also referred to as "condition (a)" in the following description).

Note that, in the case where there are a plurality of depths at which the 2p peak of Zn reaches its maximum, a depth that is the closest to the surface of the insulating coating film of the depths is to be adopted. This also applies to the depth at which the 2p peak of Al reaches its maximum.

Figure 2:
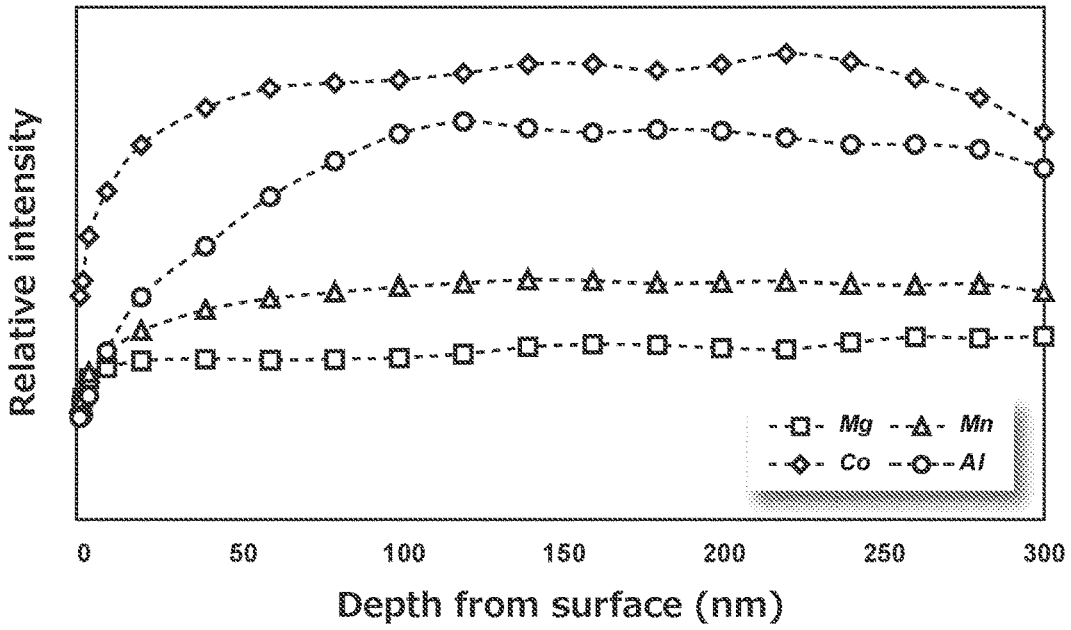
FIG. 2 is a graph for describing behaviors of XPS spectra of insulating coating films for a non-oriented electrical steel sheet.
Figure 3:
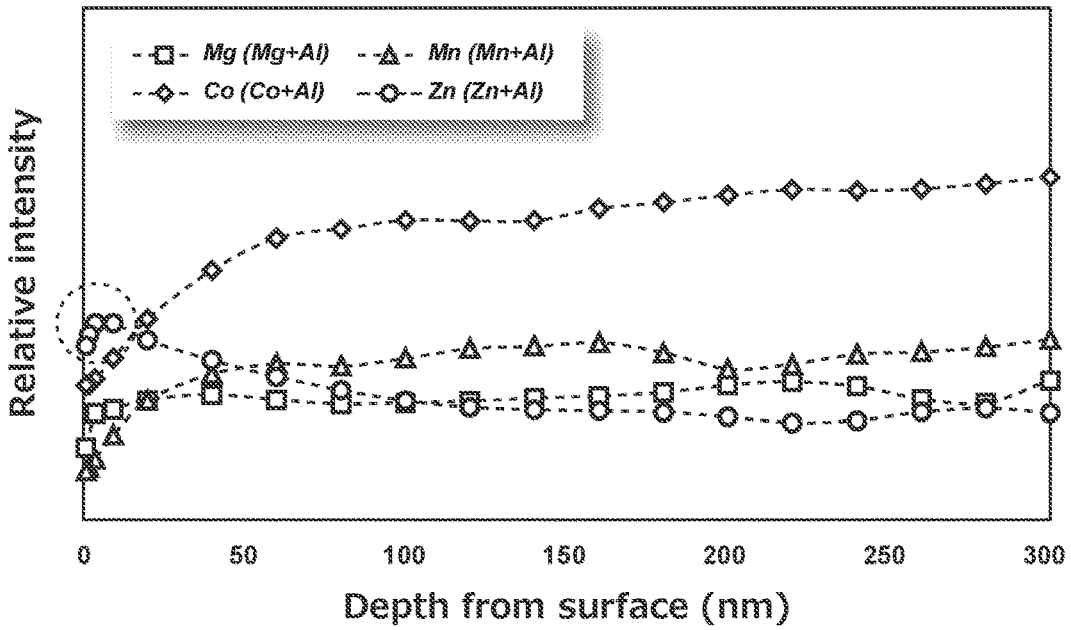
FIG. 3 is a graph for describing behaviors of XPS spectra of insulating coating films for a non-oriented electrical steel sheet.
Figure 4:
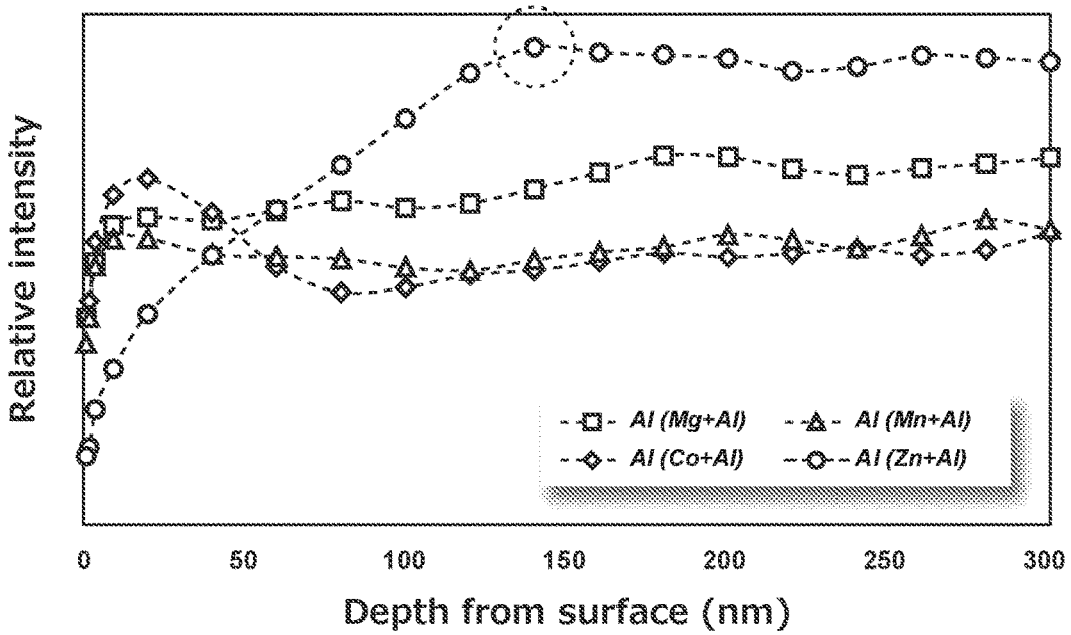
FIG. 4 is a graph for describing behaviors of XPS spectra of insulating coating films for a non-oriented electrical steel sheet.

As described above, since metal phosphates are normally unstable in their aqueous solutions, metal phosphates tend to precipitate early to be concentrated on the base metal steel sheet side. FIG. 2 to FIG. 4 are each a graph for describing behaviors of XPS spectra of insulating coating films for a non-oriented electrical steel sheet. FIG. 2 illustrates the results of XPS spectrum measurement performed on samples on which four types of insulating coating films containing magnesium phosphate, cobalt phosphate, manganese phosphate, and aluminum phosphate are formed. In other words, FIG. 2 illustrates analysis results concerning 2p peaks of Mg, Co, Mn, and Al in the insulating coating films. Note that, for the four samples, base metal steel sheets used and components of the insulating coating films other than the metal phosphates were the same, and measurement conditions were also the same.

As illustrated in FIG. 2, in the case where a metal phosphate of one metallic element was used to form an insulating coating film, the results were that the strength of the 2p peak decreased as the depth was closer to the surface, for all of the metallic elements. From this result too, it is understood that metal phosphates are unstable in their aqueous solutions and tend to be concentrated on the base metal steel sheet side.

Next, the present inventors performed the same analysis on four samples on which an insulating coating film containing aluminum phosphate and zinc phosphate, an insulating coating film containing aluminum phosphate and magnesium phosphate, an insulating coating film containing aluminum phosphate and cobalt phosphate, and an insulating coating film containing aluminum phosphate and manganese phosphate. Results of the analysis are illustrated in FIG. 3 and FIG. 4.

FIG. 3 illustrates analysis results concerning 2p peaks of Zn, Mg, Co, and Mn in the insulating coating films, and FIG. 4 illustrates analysis results concerning 2p peaks of Al in the insulating coating films.

As illustrated in FIG. 3, the results were that the strengths of the 2p peaks of Mg, Co, and Mn decreased as the depth was closer to the surface. In contrast, it is seen that the 2p peak of Zn reached its maximum near the surface of the insulating coating film and then gradually decreased, as illustrated by a region enclosed by a broken line.

In addition, as illustrated in FIG. 4, strengths of the 2p peaks of Al in the insulating coating films in combinations with Mg, Co, and Mn reached their maximums near the surface of the insulating coating films, whereas the strength of the 2p peak of Al in a combination with Zn reached its maximum at a depth of about 150 nm, as illustrated by a region enclosed by a broken line. As is clear from the comparison between FIG. 3 and FIG. 4, the results were that a depth at which the strength of the 2p peak of Zn reached its maximum was present closer to the surface than a depth at which the strength of the 2p peak of Al reached its maximum was present only when the aluminum phosphate and the zinc phosphate were used in combination.

Cases where at least any one of magnesium phosphate, cobalt phosphate, manganese phosphate, and nickel phosphate is contained in addition to aluminum phosphate and zinc phosphate were checked in the same manner as the above, as a result of which the position relationship between aluminum phosphate and zinc phosphate was reproduced.

Furthermore, when measurement by the XPS is performed on the non-oriented electrical steel sheet according to the present invention, the maximum value of the strength of the 2p peak of Zn is 1 to 20 times the strength of the 2p peak of Al at a depth at which the strength of the 2p peak of Zn reaches its maximum (hereinafter also referred to as "maximum Zn depth") (also referred to as "condition (b)" in the following description). In other words, at the maximum Zn depth, the strength of the 2p peak of Zn is 1 to 20 times the strength of the 2p peak of Al.

If the strength of the 2p peak of Zn is less than one time the strength of the 2p peak of Al at the maximum Zn depth, a sufficient amount of zinc phosphate is not concentrated near the surface of the insulating coating film, resulting in a failure to obtain an excellent corrosion resistance. On the other hand, if the strength of the 2p peak of Zn is more than 20 times the strength of the 2p peak of Al, the amount of aluminum phosphate becomes so small that an excellent adhesiveness and heat resistance cannot be provided. At the maximum Zn depth, the strength of the 2p peak of Zn is preferably 1.2 times or more the strength of the 2p peak of Al, more preferably 1.5 times or more. In addition, the strength of the 2p peak of Zn is preferably 10 times or less the strength of the 2p peak of Al, more preferably 5 times or less.

Here, the XPS is a measurement method that is suitable for observing a distribution of chemical species while distinguishing among the chemical species. From the observation using the XPS in which spattering is performed on the insulating coating film along the thickness direction, a thickness-direction distribution of metal phosphates can be determined.

Specifically, the 2p peak (a peak concerning 2p electrons) of Al is an XPS peak from Al—O bond in the aluminum phosphate, which is observed near a binding energy of 76 eV, and the 2p peak (a peak concerning 2p electrons) of Zn is an XPS peak from Zn—O bond in the zinc phosphate, which is observed near a binding energy of 1023 eV.

Likewise, 2p peaks (peaks concerning 2p electrons) of the other metallic elements M (Co, Mg, Mn, and Ni) are XPS peaks from M-O bonds in the metal phosphates of the metallic elements M, which are observed, for example, near the following binding energies.

Cobalt phosphate: 780 to 790 eV
Magnesium phosphate: 50 to 54 eV
Manganese phosphate: 642 to 650 eV
Nickel phosphate: 848 to 855 eV The XPS spectra can be measured with a commercial X-ray photoelectron spectrometer. Conditions for measuring the XPS spectra are to be set as follows.

Measuring instrument: XPS measuring instrument PHI5600 from ULVAC-PHI, Inc.
X-ray source: MgKα
Analysis area: 800 μmϕ
Sputtering yield: 2 nm/min (in terms of $SiO_2$)
Measured surface: outermost surface, 0.1, 0.5, 1, 2, 5, 10 min, and 10 min intervals 3-2. Organic Resin The organic resin contained in the insulating coating film is present in a state of being dispersed in the metal phosphate functioning as a binder. The presence of the organic resin in the metal phosphate makes it possible to restrain grains of the metal phosphate from growing to be large and accelerate the polycrystallization of the metal phosphate, enabling the formation of a close-grained insulating coating film.

There is no particular limitation on the type of the organic resin, and one, or two or more types of various known organic resins such as acrylic resin, polystyrene resin, vinyl acetate resin, epoxy resin, polyurethane resin, polyamide resin, phenolic resin, melamine resin, silicon resin, polypropylene resin and polyethylene resin. However, it is preferable to use acrylic resin as the organic resin from the viewpoint of the stability of acid solution.

The acrylic resin may be, for example, a polymer of a single type of monomer or a copolymer of two or more types of monomers. Examples of available monomers constituting the acrylic resin include, but not particularly limited to, methyl acrylate, ethyl acrylate, n-butyl acrylate, i-butyl acrylate, n-octyl acrylate, i-octyl acrylate, 2-ethylhexyl acrylate, n-nonyl acrylate, n-decyl acrylate, and n-dodecyl acrylate. In addition, acrylic acid, methacrylic acid, maleic acid, maleic anhydride, fumaric acid, crotonic acid, itaconic acid, and the like can be used as monomers with a functional group, and 2-hydroxylethyl(meth)acrylate, 2-hydroxylpropyl(meth)acrylate, 3-hydroxylbutyl(meth)acrylate, 2-hydroxylethyl(meth)allylether, and the like can be used as monomers with a hydroxyl group.

3-3. Water-Soluble Organic Compound

The water-soluble organic compound contained in the insulating coating film is an organic compound that is water-soluble and compatible with an inorganic solution of a metal phosphate or the like, such as alcohol, ester, ketone, ether, carboxylic acid, and sugar. By blending the water-soluble organic compound into treatment liquid containing the metal phosphate and the organic resin, the water-soluble organic compound is contained in inorganic components of the metal phosphate and the like when the treatment liquid is applied to the surface of the steel sheet and dried. Note that, in the present embodiment, being water-soluble means properties of being dissolved in water unlimitedly or partially.

The water-soluble organic compound according to the present embodiment has an SP value that is within the range of 10.0 to 20.0 $(cal/cm^3)^{1/2}$. Here, the SP value is what is called a solubility parameter, representing a miscibility between substances.

SP values are characteristic values each specific to a substance, and thus literature data may be used for a pure substance. In the case where a specific value of an SP value is obtained from an actual measurement, the value may be determined from a measured value of evaporation energy, and for an aqueous solution, the value may be determined from a change in turbidity when a poor solvent is added to the aqueous solution or may be determined from a solubility of the aqueous solution in a solvent the SP value of which is known.

If the SP value is less than 10.0 $(cal/cm^3)^{1/2}$, it is impossible to improve the stability of zinc phosphate sufficiently, and zinc phosphate is widely distributed in the insulating coating film, not presenting a distinct peak. As a result, although the maximum value of the strength of the 2p peak of Zn is present near the surface of the insulating coating film, the maximum value is not greater than the strength of the 2p peak of Al at the depth, and it is not possible to improve corrosion resistance sufficiently. In other words, the condition (b) is not satisfied. In addition, the water-soluble organic compound is easily separated in the treatment liquid, which can cause uneven coating and poor coating. On the other hand, if the SP value is more than 20.0 $(cal/cm^3)^{1/2}$, interaction with the metal phosphate becomes extremely weak, so that zinc phosphate is not stabilized, and aluminum phosphate is concentrated on the surface side of the insulating coating film. In other words, the condition (a) is not satisfied.

Specifically, examples of the water-soluble organic compound according to the present embodiment can include straight-chain alcohols such as butanol and propanol as alcohols, polyols such as propylene glycol, glycerin, ethylene glycol, and triethylene glycol, carboxylic acids such as ketones including methyl ethyl ketone, diethyl ketone, and the like, acetic acid, and propionic acid, carboxylates such as sodium maleate, sugars such as sucrose and fructose, cellosolves such as methyl cellosolve and butyl cellosolve, carbitols such as diethylene glycol monomethyl ether and diethylene glycol diethyl ether, esters such as ethers including tetraethylene glycol dimethyl ether, 1,4-dioxane, and the like, and ethylene glycol monomethyl ether acetate. Of these various water-soluble organic compounds, those having SP values that are within the range of 10.0 to 20.0 $(cal/cm^3)^{1/2}$ can be favorably used.

As a water-soluble organic compound, phosphonic acid is often used. However, phosphonic acid has an SP value that does not satisfy the specified range and additionally has an acidity that is relatively high. Thus, if a sufficient time is kept from the application of a surface treatment agent containing phosphonic acid on the surface of the base metal steel sheet until the solidification of the surface treatment agent, rust may form on the surface of the base metal steel sheet.

The water-soluble organic compound remains in the coating film after coating and baking. At this time, even if the boiling point or the sublimation point of the water-soluble organic compound is lower than the boiling point of water, the water-soluble organic compound remains in the coating film after the coating and baking since the water-soluble organic compound and the metal phosphate interact with each other. In addition, in actual operation, a time taken to dry and bake the coating film is about several seconds, and thus the water-soluble organic compound is to remain in the coating film.

However, to cause the water-soluble organic compound to remain in the coating film after the coating and baking more reliably, the boiling point of the water-soluble organic compound is preferably higher than the boiling point of water in the case where the water-soluble organic compound is liquid, and the sublimation point of the water-soluble organic compound is preferably higher than the boiling point of water in the case where the water-soluble organic compound is solid. More favorably, the boiling point or the sublimation point of the water-soluble organic compound according to the present embodiment is preferably 150° C. or more, more preferably 200° C. or more. By using a water-soluble organic compound having the boiling point or the sublimation point of 150° C. or more, it is possible to restrain the residual ratio of the water-soluble organic compound in the coating film from decreasing to make an effect of adding the water-soluble organic compound exert more reliably. On the other hand, the boiling point or the sublimation point of the water-soluble organic compound according to the present embodiment is preferably less than 300° C. If the boiling point or the sublimation point of the water-soluble organic compound is 300° C. or more, the water-soluble organic compound can cause surface tackiness and deliquescence.

4. Coating Thickness of Insulating Coating Film

The thickness of the insulating coating film is preferably about 0.3 to 5.0 μm, more preferably about 0.5 μm to 2.0 μm. By specifying the coating thickness of the insulating coating film within the range, it is possible to keep more excellent uniformity.

5. Surface Treatment Agent for Non-Oriented Electrical Steel Sheet

Next, a surface treatment agent used for forming the insulating coating film when the non-oriented electrical steel sheet is produced will be described below in detail.

The surface treatment agent according to the present embodiment is an aqueous-solution-based treatment agent that is used for forming the insulating coating film described above on the surface of a base metal steel sheet functioning as the non-oriented electrical steel sheet. This surface treatment agent contains 3 to 50 parts by weight of organic resin and 5 to 50 parts by weight of water-soluble organic compound per 100 parts by weight of metal phosphate containing aluminum and zinc.

Here, as the metal phosphate, the organic resin, and the water-soluble organic compound in the surface treatment agent, the metal phosphate, the organic resin, and the water-soluble organic compound that are mentioned above to be used.

In addition, in the metal phosphate contained in the surface treatment agent according to the present embodiment, the molar ratio between aluminum element and zinc element (Al:Zn) is to be within the range of 10:90 to 75:25. By setting the molar ratio between aluminum element and zinc element to be within the range, an insulating coating film formed with the surface treatment agent satisfies the condition (a) and the condition (b) concerning the XPS spectra. The molar ratio between aluminum element and zinc element (Al:Zn) in the metal phosphate in the surface treatment agent is preferably within the range of 30:70 to 50:50.

Note that the value of the molar ratio (Al:Zn) can be calculated from the molar quantities of aluminum element and zinc element obtained by determination by the analysis of the obtained surface treatment agent with an inductively coupled plasma (ICP) atomic emission spectrometer.

The content of the organic resin contained in the surface treatment agent is set to be 3 to 50 parts by weight per 100 parts by weight of the metal phosphate. By setting the content of the organic resin to be within the range, it is possible particularly to increase the stability of the zinc phosphate, so that the condition (a) and the condition (b) can be satisfied. In addition, by setting the content of the organic resin to be 50 parts by weight or less, it is possible to increase the concentration of the metal phosphate in a relative manner and ensure a heat resistance.

The content of the organic resin is, per 100 parts by weight of the metal phosphate, preferably 5 parts by weight or more, more preferably 10 parts by weight or more. In addition, the content of the organic resin is, per 100 parts by weight of the metal phosphate, preferably 40 parts by weight or less, more preferably 30 parts by weight or less.

By making the water-soluble organic compound having the SP value within the range described above contained by an adequate amount in the surface treatment agent according to the present embodiment, zinc phosphate is concentrated on the surface side of the insulating coating film, making it possible to form a coating film in which aluminum phosphate is concentrated on its base metal steel sheet side. The content of the water-soluble organic compound contained in the surface treatment agent is set to be 5 to 50 parts by weight per 100 parts by weight of the metal phosphate. By setting the content of the water-soluble organic compound to be within the range, it is possible to particularly increase the stability of the zinc phosphate, so that the condition (a) and the condition (b) can be satisfied.

In addition, by setting the content of the water-soluble organic compound to be 5 parts by weight or more, punchability is also improved. Moreover, by setting the content of the water-soluble organic compound to be 50 parts by weight or less, it is possible to restrain the insulating coating film from becoming sticky or cloudy, so that a shiny coating surface can be obtained. The content of the water-soluble organic compound is, per 100 parts by weight of the metal phosphate, preferably 8 parts by weight or more, more preferably 10 parts by weight or more. In addition, the content of the water-soluble organic compound is, per 100 parts by weight of the metal phosphate, preferably 30 parts by weight or less, more preferably 20 parts by weight or less.

In the surface treatment agent according to the present embodiment, in addition to the components described above, for example, a binder component such as an inorganic compound of carbonate, hydroxide, oxide, titanate, and tungstate. Moreover, a brightener or the like may be additionally contained in the treatment liquid.

6. Production Method for Non-Oriented Electrical Steel Sheet

A production method for the non-oriented electrical steel sheet according to the present embodiment is a production method for producing a non-oriented electrical steel sheet that includes a base metal steel sheet and an insulating coating film. The production method according to the present embodiment includes a step of applying the surface treatment agent described above to the surface of the base metal steel sheet and a step of heating the base metal steel sheet with the surface treatment agent applied thereto to form the insulating coating film.

Here, as an application method for applying the surface treatment agent on the surface of the base metal steel sheet is not particularly limited, and various known application systems can be used. As such application systems, for example, a roll coater system may be used, or an application system such as a spraying system and a dipping system may be used.

In addition, as described above, it is necessary to keep a time for the elements in the surface treatment agent to diffuse sufficiently, from the application of the surface treatment agent to the surface of the base metal steel sheet until the surface treatment agent is solidified. To this end, first, the base metal steel sheet is left for 1.5 seconds or more from the application of the surface treatment agent until heating. Subsequently, when heating is performed on the base metal steel sheet with the surface treatment agent applied thereto to form the insulating coating film, a heating temperature is set at 220° C. or more to less than 260° C., and an average heating rate is set at less than 25° C./sec from the start of the heating until the heating temperature is reached. There is no particular limitation on the temperature at the start of the heating, and the temperature may be a temperature near a room temperature.

In addition, there is no particular limitation on a heating system, either; a typical radiant heater or air-heating furnace is available, and heating using electricity such as an induction heating system may be used.

The present invention will be described below more specifically with reference to examples, but the present invention is not limited to these examples.

Example

In the present example, base metal steel sheets that included chemical components consisting of, in mass %, Si: 3.1%, Al: 0.6%, and Mn: 0.2%, with the balance being Fe and impurities, had a sheet thickness of 0.30 mm, and had an arithmetic average roughness Ra of 0.32 μm were used.

On the surfaces of the base metal steel sheets, treatment liquids having compositions shown in Table 1 were applied such that an amount of application is 1.0 g/m$^2$, and the base metal steel sheets were subjected to baking under the conditions shown in Table 2. Note that the meanings of symbols for types of water-soluble organic compounds shown in Table 1 are as shown in Table 3. In Table 2, the heating rates each mean an average heating rate for from the room temperature to the heating temperatures, and the heating times each mean a time of retention at the corresponding heating temperatures.

TABLE 1

| | Metal phosphate | | | | | Water-soluble organic compound | | Organic resin | |
|---|---|---|---|---|---|---|---|---|---|
| | Aluminum | Zinc | | Third element | | | | | |
| No. | Blending amount (part by weight) | Blending amount (part by weight) | Al:Zn molar ratio | Element | Blending amount (part by weight) | Type | Blending amount (part by weight) | Type | Blending amount (part by weight) |
| 1 | 50 | 50 | 45:55 | | — | GL | 10 | Acrylic resin | 30 |
| 2 | 77 | 23 | 73:27 | | — | EG | 10 | Acrylic resin | 20 |
| 3 | 17 | 83 | 14:86 | | — | IPA | 6 | Acrylic resin | 15 |
| 4 | 33 | 50 | 35:65 | Mg | 17 | POESMO | 15 | Epoxy resin | 10 |
| 5 | 33 | 47 | 36:64 | Mn | 20 | PEGMS | 20 | Epoxy resin | 20 |
| 6 | 33 | 50 | 35:65 | Co | 17 | POESMO | 10 | Epoxy resin | 40 |
| 7 | 33 | 43 | 38:62 | Ni | 24 | POESMO | 10 | Epoxy resin | 10 |
| 8 | 50 | 50 | 45:55 | | — | IPA | 10 | Acrylic resin | 5 |
| 9 | 50 | 50 | 45:55 | | — | EG | 40 | Epoxy resin | 40 |
| 10 | 100 | 0 | 100:0 | | — | PEGMS | 20 | Epoxy resin | 30 |
| 11 | 96 | 4 | 95:5 | | — | PEGMS | 20 | Epoxy resin | 30 |
| 12 | 0 | 100 | 0:100 | | — | PEGMS | 20 | Epoxy resin | 40 |
| 13 | 3 | 97 | 2:98 | | — | PEGMS | 20 | Epoxy resin | 30 |
| 14 | 50 | 50 | 45:55 | | — | MEK | 10 | Acrylic resin | 30 |
| 15 | 33 | 50 | 35:65 | Mg | 17 | EA | 5 | Acrylic resin | 30 |
| 16 | 50 | 50 | 45:55 | | — | SML | 10 | Acrylic resin | 30 |
| 17 | 33 | 50 | 35:65 | Co | 17 | PEMO | 20 | Acrylic resin | 30 |
| 18 | 50 | 50 | 45:55 | | — | IPA | 3 | Acrylic resin | 30 |
| 19 | 50 | 50 | 45:55 | | — | GL | 60 | Acrylic resin | 30 |
| 20 | 50 | 50 | 45:55 | | — | IPA | 10 | Acrylic resin | 2 |
| 21 | 50 | 50 | 45:55 | | — | EG | 10 | Epoxy resin | 60 |

TABLE 1-continued

| | Metal phosphate | | | | | Water-soluble | | | |
|---|---|---|---|---|---|---|---|---|---|
| | Aluminum | Zinc | | Third element | | organic compound | | Organic resin | |
| No. | Blending amount (part by weight) | Blending amount (part by weight) | Al:Zn molar ratio | Element | Blending amount (part by weight) | Type | Blending amount (part by weight) | Type | Blending amount (part by weight) |
| 22 | 50 | 0 | 100:0 | Co | 50 | POESMO | 10 | Epoxy resin | 30 |
| 23 | 50 | 0 | 100:0 | Mn | 50 | PEGMS | 10 | Epoxy resin | 30 |
| 24 | 50 | 0 | 100:0 | Mg | 50 | POESMO | 10 | Epoxy resin | 30 |
| 25 | 50 | 0 | 100:0 | Ni | 50 | POESMO | 10 | Epoxy resin | 30 |
| 26 | 50 | 50 | 45:55 | — | | — | | Acrylic resin | 30 |
| 27 | 50 | 50 | 45:55 | — | | GL | 10 | Acrylic resin | 30 |
| 28 | 50 | 50 | 45:55 | — | | GL | 10 | Acrylic resin | 30 |
| 29 | 50 | 50 | 45:55 | — | | GL | 10 | Acrylic resin | 30 |

TABLE 2

| | Time from | Heating condition | | |
|---|---|---|---|---|
| No. | application until heating (s) | Heating rate (° C./s) | Heating temperature (° C.) | Heating time (s) |
| 1 | 1.7 | 17.3 | 250 | 30 |
| 2 | 2.1 | 14.3 | 250 | 30 |
| 3 | 1.5 | 23.9 | 250 | 30 |
| 4 | 1.9 | 15.3 | 250 | 30 |
| 5 | 2.8 | 10.6 | 250 | 30 |
| 6 | 1.9 | 15.3 | 250 | 30 |
| 7 | 1.9 | 15.3 | 250 | 30 |
| 8 | 1.5 | 23.9 | 250 | 30 |
| 9 | 2.1 | 14.3 | 250 | 30 |
| 10 | 2.8 | 10.6 | 250 | 30 |
| 11 | 2.8 | 10.6 | 250 | 30 |
| 12 | 2.8 | 10.6 | 250 | 30 |
| 13 | 2.8 | 10.6 | 250 | 30 |
| 14 | 1.6 | 18.4 | 250 | 30 |
| 15 | 2.1 | 14.3 | 250 | 30 |
| 16 | 2.1 | 14.3 | 250 | 30 |
| 17 | 2.1 | 14.3 | 250 | 30 |
| 18 | 1.5 | 23.9 | 250 | 30 |
| 19 | 1.5 | 23.9 | 250 | 30 |
| 20 | 1.5 | 23.9 | 250 | 30 |
| 21 | 1.5 | 23.9 | 250 | 30 |
| 22 | 2.8 | 10.6 | 250 | 30 |
| 23 | 2.8 | 10.6 | 250 | 30 |
| 24 | 2.8 | 10.6 | 250 | 30 |
| 25 | 2.8 | 10.6 | 250 | 30 |
| 26 | 1.9 | 15.3 | 250 | 30 |
| 27 | 0.4 | 24.6 | 250 | 30 |
| 28 | 1.5 | 34.3 | 250 | 30 |
| 29 | 1.7 | 17.3 | 360 | 30 |

TABLE 3

| Symbol | Name of organic compound | SP value $((cal/cm^3)^{1/2})$ |
|---|---|---|
| IPA | Isopropanol | 11.5 |
| EG | Ethylene glycol | 14.2 |
| GL | Glycerin | 16.5 |
| POESMO | Polyoxyethylene sorbitan monooleate | 18.8 |
| PEGMS | Polyethylene glycol monostearate | 19.1 |
| MEK | Methyl ethyl ketone | 9.3 |
| EA | Ethyl acetate | 9.1 |
| SML | Sorbitan monolaurate | 20.4 |
| PEMO | Pentaerythritol monooleate | 22.1 |

As the metal phosphate, metal phosphate treatment liquids are prepared by mixing and stirring orthophosphoric acid, and hydroxides, oxides, and carbonates of metals such as $Al(OH)_3$, ZnO, and $Mg(OH)_2$, and the metal phosphate treatment liquids are made into their 40 mass % aqueous solutions. Note that the reagents used were all commercially available.

Table 1 shows the blending amounts of aluminum phosphate in metal phosphates, the blending amounts of zinc phosphate in the metal phosphates, and the blending amounts of a metal phosphate of a third element in the metal phosphates in terms of parts by weight. Table 1 also shows molar ratios between aluminum element and zinc element in the metal phosphates.

The water-soluble organic compounds used are also commercially available and have SP values shown in Table 3.

As an acrylic resin, an acrylic resin that was made by copolymerizing 30 mass % of methyl methacrylate, 45 mass % of styrene monomer, 10 mass % of 2-hydroxyethyl methacrylate, and 5 mass % of ethylene glycol methacrylate with 5 mass % of anionic reactive surfactant and 5 mass % of nonionic reactive surfactant and made into its 30% emulsion solution was used. Note that the reagents used for the polymerization into the acrylic resin were all commercially available.

As an epoxy resin, an epoxy resin that was made by denaturing bisphenol A epoxy resin with monoethanolamine and then subjected to graft polymerization with succinic anhydride to be emulsified was used. Note that the reagents used for the polymerization into the epoxy resin were all commercially available.

The blending proportions of the metal phosphate, the water-soluble organic compound, and the organic resin in each of the treatment liquids shown in Table 1 are the blending proportions of the metal phosphate, the water-soluble organic compound, and the organic resin in each of the insulating coating films after the application and the drying.

An XPS spectrum was measured on each of samples of the obtained non-oriented electrical steel sheets, and whether the condition (a) and the condition (b) were satisfied was determined. A sample satisfying a condition was given a grade "A" for the condition, and a sample not satisfying a condition was given a grade "B" for the condition. Conditions for measuring the XPS spectrum were as mentioned above.

In addition, each sample was subjected to various evaluation tests. How to evaluate the produced samples will be described below in detail.

For adhesiveness, steel sheet samples with adhesive tapes attached thereto were wound around metal bars having diameters of 10 mm, 20 mm, and 30 mm, then the adhesive tapes were torn off, and the adhesiveness was evaluated from traces of the tearing. A sample that was not torn off even when the sample was bent around 10 mmϕ) was given a grade "A", a sample that was not torn off when the sample was bent around 20 mmϕ) was given a grade "B", a sample that was not torn off when the sample was bent around 30 mmϕ) was given a grade "C", and a sample that was torn off was given a grade "D". For adhesiveness, samples that were given the grade "A" or "B" were rated as good.

For insulation property, based on a surface insulation resistance measured in conformity to the JIS (JIS C2550-4: 2019), a sample of a surface insulation resistance of less than 5 $\Omega \cdot cm^2$/sheet was given a grade "D", a sample of a surface insulation resistance 5 $\Omega \cdot cm^2$/sheet or more to less than 10 $\Omega \cdot^2$/sheet was given a grade "C", a sample of a surface insulation resistance of 10 $\Omega \cdot cm^2$/sheet or more to less than 50 $\Omega \cdot^2$/sheet was given a grade "B", and a sample of a surface insulation resistance of 50 $\Omega \cdot cm^2$/sheet or more was given a grade "A". For insulation property, samples that were given the grade "A" or "B" were rated as good.

Heat resistance was evaluated in terms of corrosion resistance after stress relieving annealing. The samples were subjected to heat treatment for 1 hour in a 100%-nitrogen atmosphere at 850° C. and subsequently left in a temperature and humidity controlled chamber at a temperature of 50° C. and a humidity of 90% for 48 hours, and an area fraction of rust occurred on the surface of each sample was evaluated as in the evaluation of corrosion resistance. Evaluation criteria are shown below; grades 9 and 10 were determined as "A", grades 6, 7, and 8 were determined as "B", grades 4 and 5 were determined as "C", grades 1, 2, and 3 were determined as "D", and samples given the grades "A" or "B" were rated as good.

For workability, the breaking load of each sample was measured and used as an index for workability. A cutting blade was set to come into contact perpendicularly with the sample worked into 3 cm×6 cm, and a load under which the sample was broken was measured. The breaking load was compared with a breaking load of a sample with no insulating coating film applied thereto; a ratio between the breaking loads being less than 0.95 was determined as "A", the ratio being 0.95 or more to less than 1.00 was determined as "B", the ratio being 1.00 or more to less than 1.05 was determined as "C", the ratio being 1.05 or more to less than 1.10 was determined as "D", and the ratio being 1.10 or more was determined as "E". Samples given the grades "A" or "B" for the workability were rated as good.

Corrosion resistance was evaluated in conformity to the salt spray test according to the JIS (JIS Z2371:2015). Specifically, each sample underwent 5 cycles each including a step of spraying 5%-NaCl aqueous solution in an atmosphere at 35° C. for 1 hour on the sample, a step of retaining the sample in an atmosphere at a temperature of 60° C. and a humidity of 40% for 3 hours, and a step of retaining the sample in an atmosphere at a temperature of 40° C. and a humidity of 95% for 3 hours, and then an area fraction of rust occurring on the surface of the sample was evaluated on a 10-point scale. Evaluation criteria are shown below. Samples given a grade of 5 or more for corrosion resistance were rated as good.

10: No rust occurring
9: Very small amount of rust occurring (area fraction being 0.10% or less)
8: Area fraction of rust occurring=more than 0.10% to 0.25% or less
7: Area fraction of rust occurring=more than 0.25% to 0.50% or less
6: Area fraction of rust occurring=more than 0.50% to 1.0% or less
5: Area fraction of rust occurring=more than 1.0% to 2.5% or less
4: Area fraction of rust occurring=more than 2.5% to 5.0% or less
3: Area fraction of rust occurring=more than 5.0% to 10% or less
2: Area fraction of rust occurring=more than 10% to 25% or less
1: Area fraction of rust occurring=more than 25% to 50% or less For appearance, a sample that was shiny, smooth, and uniform was given a grade 5, a sample that was shiny but slightly poor in uniformity was given a grade 4, a sample that was a little shiny and was smooth but poor in uniformity was given a grade 3, a sample that was little shine and slightly poor in smoothness and poor in uniformity was given a grade 2, and a sample that was poor in shine, uniformity, and smoothness was given a grade 1. Samples given a grade of 3 or more for appearance were rated as good.

For each sample, the thickness of its insulating coating film was measured with an electrical coating thickness tester, and a space factor (%) was calculated from measurement values of the insulating coating film on the surfaces of its base metal steel sheet and the sheet thickness of the base metal steel sheet (300 μm). The space factor in the present example can be calculated with a coating thickness $d_1$ (μm) of the insulating coating film illustrated in FIG. 1 as Space factor (%)=$\{300\ \mu m/(300\ \mu m+2\times d_1)\}\times 100$.

Obtained results are collectively shown in Table 4.

TABLE 4

| | XPS spectra | | Evaluation result | | | | | | | |
|---|---|---|---|---|---|---|---|---|---|---|
| No. | Condition (a) | Condition (b) | Adhesiveness | Insulation property | Heat resistance | Workability | Corrosion resistance | Appearance | Space factor (%) | |
| 1 | A | A | B | B | A | B | 9 | 4 | 99.6 | Inventive example |
| 2 | A | A | A | B | B | A | 10 | 5 | 99.4 | Inventive example |
| 3 | A | A | B | A | A | B | 7 | 5 | 99.5 | Inventive example |
| 4 | A | A | B | B | B | B | 10 | 4 | 99.5 | Inventive example |
| 5 | A | A | B | B | B | B | 8 | 5 | 99.5 | Inventive example |
| 6 | A | A | B | B | B | B | 9 | 5 | 99.3 | Inventive example |
| 7 | A | A | B | B | B | A | 9 | 4 | 99.4 | Inventive example |
| 8 | A | A | B | B | B | B | 7 | 4 | 99.3 | Inventive example |
| 9 | A | A | B | B | B | B | 10 | 5 | 99.3 | Inventive example |
| 10 | B | B | B | B | B | C | 3 | 4 | 99.3 | Comparative example |
| 11 | B | B | B | B | B | C | 4 | 2 | 99.4 | Comparative example |

TABLE 4-continued

| | XPS spectra | | Evaluation result | | | | | | | |
|---|---|---|---|---|---|---|---|---|---|---|
| No. | Condition (a) | Condition (b) | Adhesiveness | Insulation property | Heat resistance | Workability | Corrosion resistance | Appearance | Space factor (%) | |
| 12 | B | B | C | B | D | B | 8 | 2 | 99.2 | Comparative example |
| 13 | B | B | C | A | C | B | 7 | 5 | 99.0 | Comparative example |
| 14 | A | B | C | C | B | B | 4 | 1 | 99.6 | Comparative example |
| 15 | A | B | B | C | B | B | 3 | 2 | 99.4 | Comparative example |
| 16 | B | A | B | A | C | C | 4 | 4 | 99.3 | Comparative example |
| 17 | B | A | C | B | B | B | 2 | 1 | 98.9 | Comparative example |
| 18 | A | B | B | B | B | C | 3 | 1 | 99.2 | Comparative example |
| 19 | B | A | C | C | C | B | 7 | 2 | 99.2 | Comparative example |
| 20 | B | A | C | B | B | C | 5 | 3 | 99.2 | Comparative example |
| 21 | B | B | B | C | D | B | 8 | 3 | 99.3 | Comparative example |
| 22 | B | B | B | B | B | B | 4 | 4 | 99.4 | Comparative example |
| 23 | B | B | B | A | C | B | 3 | 3 | 99.2 | Comparative example |
| 24 | B | B | B | B | B | B | 4 | 2 | 99.3 | Comparative example |
| 25 | B | B | B | A | C | B | 3 | 3 | 99.3 | Comparative example |
| 26 | B | A | B | B | B | B | 4 | 2 | 99.4 | Comparative example |
| 27 | A | B | B | B | B | B | 2 | 4 | 99.5 | Comparative example |
| 28 | A | B | B | B | B | B | 3 | 3 | 99.5 | Comparative example |
| 29 | A | B | C | B | C | C | 3 | 4 | 99.5 | Comparative example |

As is clear from Table 4, samples in example embodiments of the present invention satisfying the specifications according to the present invention did not contain chromate and exhibited much more excellent properties in insulation property, workability, adhesiveness, corrosion resistance, and heat resistance. In contrast, samples in comparative examples falling out of any one of the specifications according to the present invention did not provide properties combining insulation property, workability, adhesiveness, corrosion resistance, and heat resistance.

REFERENCE SIGNS LIST

1. non-oriented electrical steel sheet
11. base metal steel sheet
13. insulating coating film

The invention claimed is:

1. A non-oriented electrical steel sheet comprising a base metal steel sheet and an insulating coating film that is formed on the base metal steel sheet, wherein the insulating coating film contains metal phosphate, organic resin, and water-soluble organic compound at 50 mass % or more in total with respect to a total mass of the insulating coating film, the water-soluble organic compound has an SP value that is within a range of 10.0 to 20.0 $(cal/cm^3)^{1/2}$, the metal phosphate contains aluminum and zinc as metallic elements, and when measurement by an X-ray photoelectron spectroscopy is performed from a surface of the insulating coating film in a thickness direction of the non-oriented electrical steel sheet, a depth at which a strength of a 2p peak of zinc reaches a maximum is present closer to the surface side than a depth at which a strength of a 2p peak of aluminum reaches a maximum, and a maximum value of the strength of the 2p peak of zinc is 1 to 20 times a strength of the 2p peak of aluminum at the depth at which the strength of the 2p peak of zinc reaches a maximum.

2. The non-oriented electrical steel sheet according to claim 1, wherein the insulating coating film contains, as the organic resin, 3 to 50 parts by weight of an acrylic resin per 100 parts by weight of the metal phosphate.

3. The non-oriented electrical steel sheet according to claim 1, wherein the metal phosphate further contains, as a metallic element, one or more types selected from the group of Co, Mg, Mn, and Ni.

4. The non-oriented electrical steel sheet according to claim 2, wherein the metal phosphate further contains, as a metallic element, one or more types selected from the group of Co, Mg, Mn, and Ni.

* * * * *